US007935407B2

(12) United States Patent
Chen

(10) Patent No.: US 7,935,407 B2
(45) Date of Patent: May 3, 2011

(54) DECORATIONS

(76) Inventor: Tsung-Wei Chen, Changhua (TW)

( * ) Notice: Subject to any disclaimer, the term of this patent is extended or adjusted under 35 U.S.C. 154(b) by 319 days.

(21) Appl. No.: 12/390,671

(22) Filed: Feb. 23, 2009

(65) Prior Publication Data

US 2010/0215886 A1 Aug. 26, 2010

(51) Int. Cl.
*A47G 35/00* (2006.01)

(52) U.S. Cl. ..... 428/136; 428/542.6; 428/9; 428/12

(58) Field of Classification Search ..... 428/542.6, 428/136, 7, 9, 12; 40/124.08
See application file for complete search history.

(56) References Cited

U.S. PATENT DOCUMENTS 5,167,086 A * 12/1992 Fast ..... 40/673

* cited by examiner

*Primary Examiner* — Alexander Thomas

(57) ABSTRACT

A decoration includes a main body. The main body forms an outer edge portion and an inner edge portion. The outer edge portion is formed around a periphery of the inner edge portion. The inner edge portion has at least two disconnected coil cutting lines. The cutting lines equidistantly wrap around to a center of the main body and connect with each other, for the main body separately forming adjacent corresponded first convolution and second convolution by the cutting lines. By means of the convolutions being respectively pulled out toward opposite sides of the outer edge portion along an axial direction for positioning, making the convolutions respectively form conical revolutions at opposite sides of the outer edge portion, achieving tri-dimensional decoration.

12 Claims, 15 Drawing Sheets

DECORATIONS

BACKGROUND

1. Field of the Invention

The present invention is applied to daily necessities, in particular, to a decoration can be used as Christmas charms, Christmas decorations, home accessories, ornaments, phone charms, and etc.

2. Description of the Related Art

Presently, for increasing personalities or increasing festival atmosphere, hanging drops are often tied to personal effects such as mobile phones, kitbags, and etc., or ornaments are often placed to places at home or places in front of the door, which need to be decorated, to decorate the required place or room according to users' requirements.

Most conventional decorations include two-dimensional or directly formed three-dimensional articles, however, two-dimensional decorations lack of spatial and stereoscopic sense; as for tri-dimensional decorations, because of its large volume, for its transportation and storage, resulting waste of space and readily resulting damages in tri-dimensional ornamentals. Also, tri-dimensional ornamentals cause the cost and difficulties in manufacturing, and therefore, induce the increase in manufacture cost.

BRIEF SUMMARY

In order to overcome the shortcomings in actual use of the conventional decorations, i.e., the large volume for the transportation and storage, and high-cost in manufacture. The present invention redesigns the decorations.

The present invention provides a decoration which is convenient to transport and store, and could greatly reduce the volume, and both has special spatial configuration design, and can be readily manufactured and is convenient for assembly.

The decoration of the present invention includes a shapable main body. The main body forms an outer edge portion and an inner edge portion. The outer edge portion is formed around a periphery of the inner edge portion. The inner edge portion has at least two disconnected coil cutting lines. The cutting lines respectively form an initiating terminal adjacent to the outer edge portion, and the cutting lines wrap around along the main body, equidistantly wind to a centre of the main body and connect with each other. The inner edge portion separately forms mutually corresponded first convolution and second convolution by the cutting lines. Initiating terminals of the first convolution and the second convolution respectively locate at adjacent sides of the cutting lines and respectively connect to the outer edge portion. The first convolution and the second convolution of the decoration are respectively pulled from the main body outwardly toward opposite sides of the main body for tensile position, making the first convolution and the second convolution respectively form tri-dimensional conical revolutions facing to different directions.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
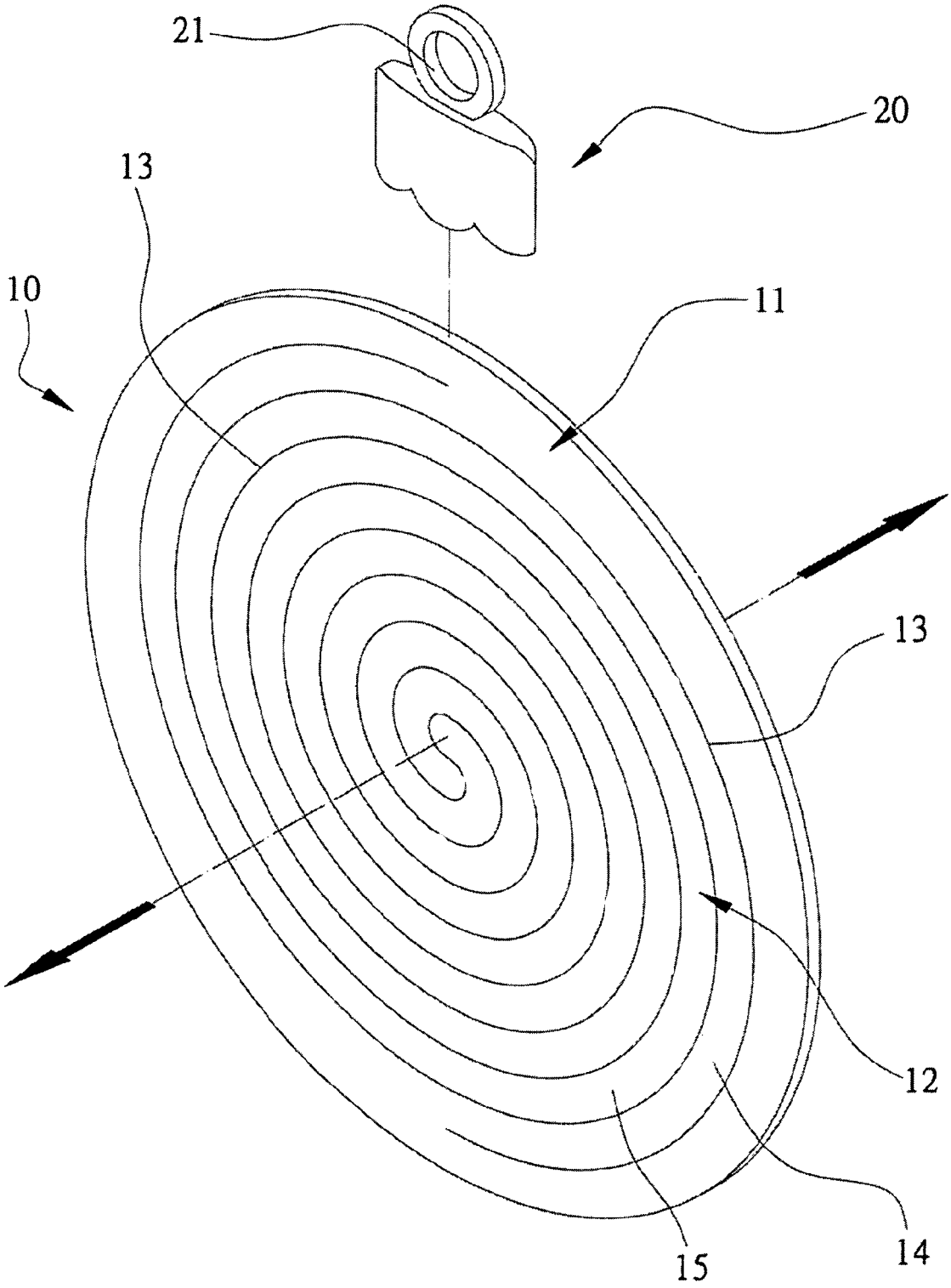
FIG. 1 is an exploded view of unexpanded state of an embodiment of the present invention.

Referring to FIG. 1, the decoration of the present invention includes a shapable main body 10 and a combining element 20.

The main body 10 may be made of metal or other shapable materials, and the main body is of circular shape as illustrated in FIG. 1. The main body 10 forms an outer edge portion 11 and an inner edge portion 12. The outer edge portion 11 is formed around a periphery of the inner edge portion 12, and the inner edge portion 12 has two disconnected coil cutting lines 13. The cutting lines 13 respectively form an initiating terminal adjacent to opposite ends of the outer edge portion 11, the cutting lines 13 wrap around along the circular contour of the main body 13, equidistantly wind to a centre of the main body 13 and connect with each other. The inner edge portion 12 separately forms mutually corresponded first convolution 14 and second convolution 15 by the cutting lines 13. Initiating terminals of the first convolution 14 and the second convolution 15 respectively locate at adjacent sides of the cutting lines 13 and respectively connect to the outer edge portion 11.

The combining element 20 is a sheet body, and is fixed to the outer edge portion 11 of the main body 10. The combining element 20 has a perforation 21 extending therethrough. By means of the forgoing structures, to achieve the decoration of the present invention.

Figure 2:
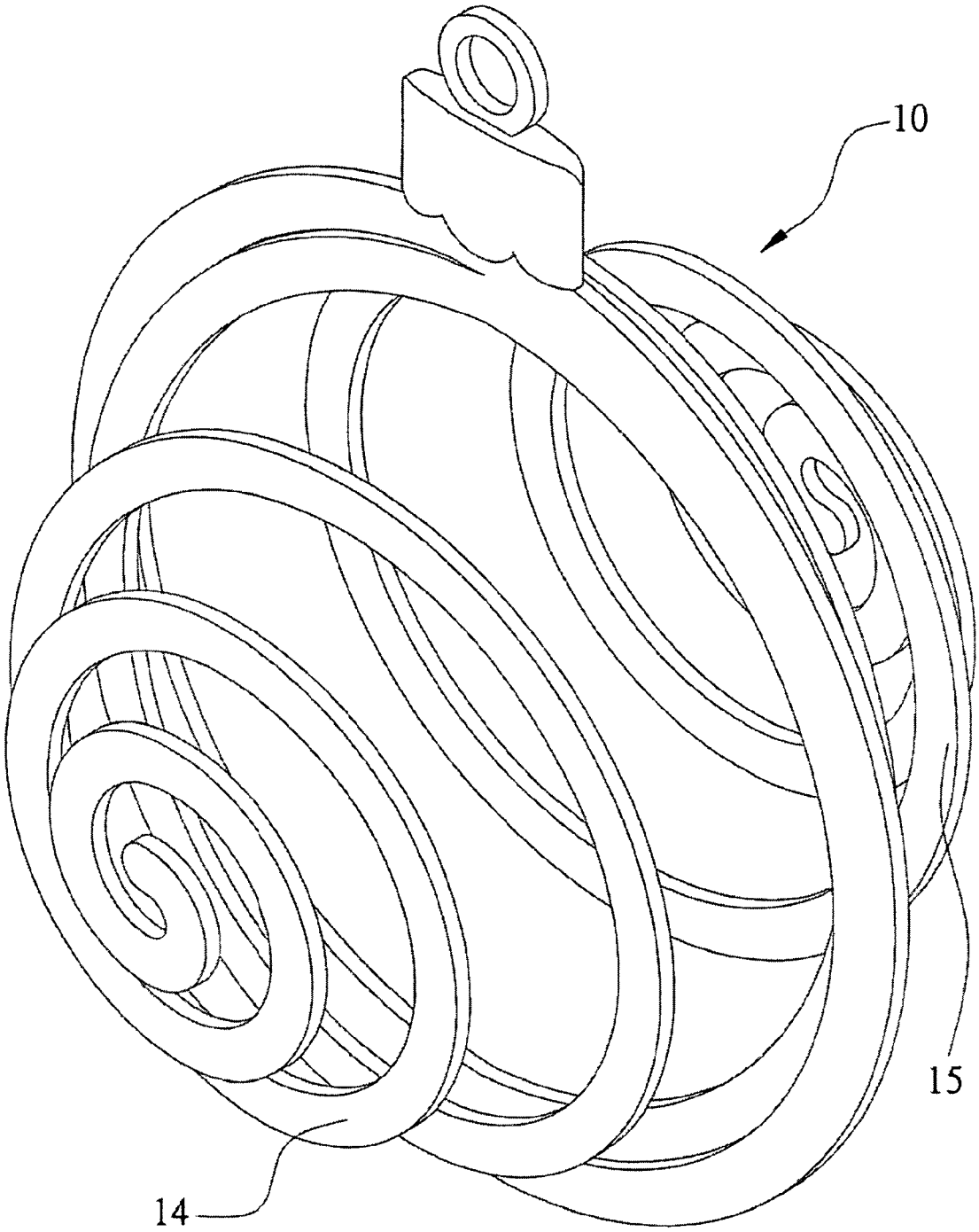
FIG. 2 is a tri-dimensional view of FIG. 1.
Figure 3:
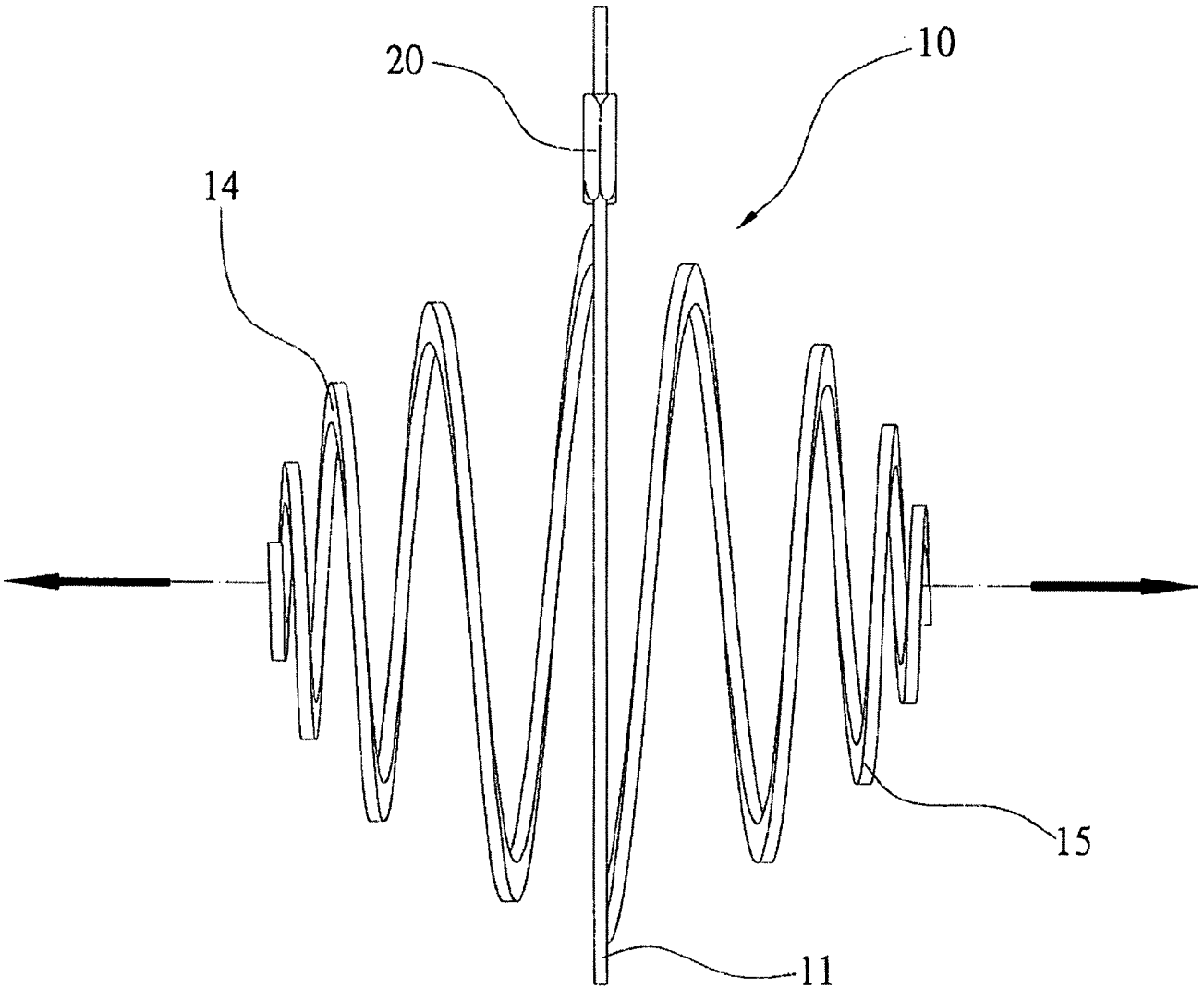
FIG. 3 is a front view of FIG. 2.

When assembling to the usage state of the decoration, referring to FIGS. 2 and 3, the first convolution 14 and the second convolution 15 of the decoration are respectively pulled out from the main body 10 toward opposite sides of the main body 10 for fix positioning, making the first convolution 14 and the second convolution 15 respectively form tri-dimensional conical revolutions facing to different directions, for forming the decoration in a tri-dimensional configuration and achieving tri-dimensional decoration.

Figure 4:
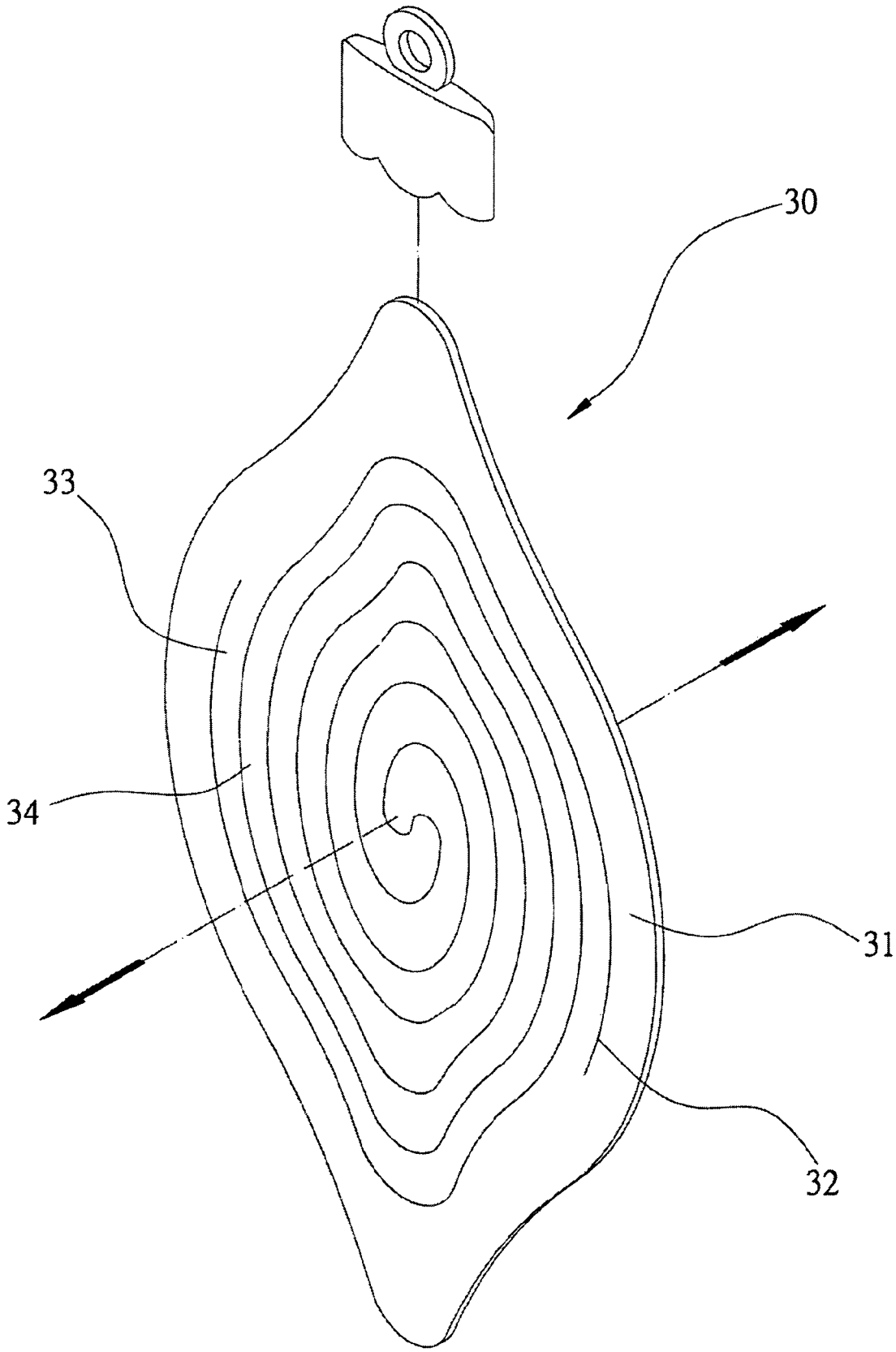
FIG. 4 is an exploded view of unexpanded state of an embodiment of the present invention.
Figure 5:
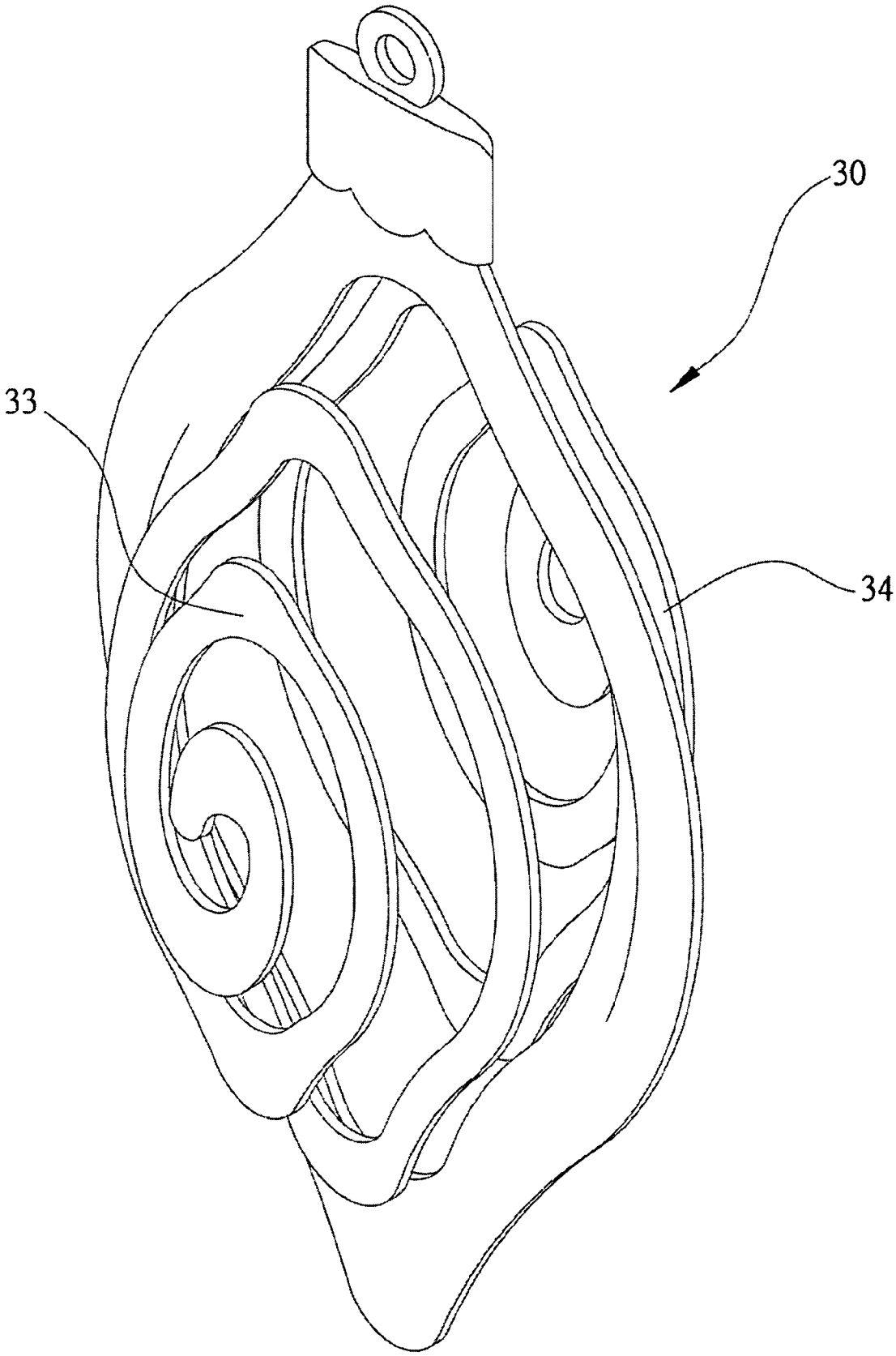
FIG. 5 is a tri-dimensional view of FIG. 4.
Figure 6:
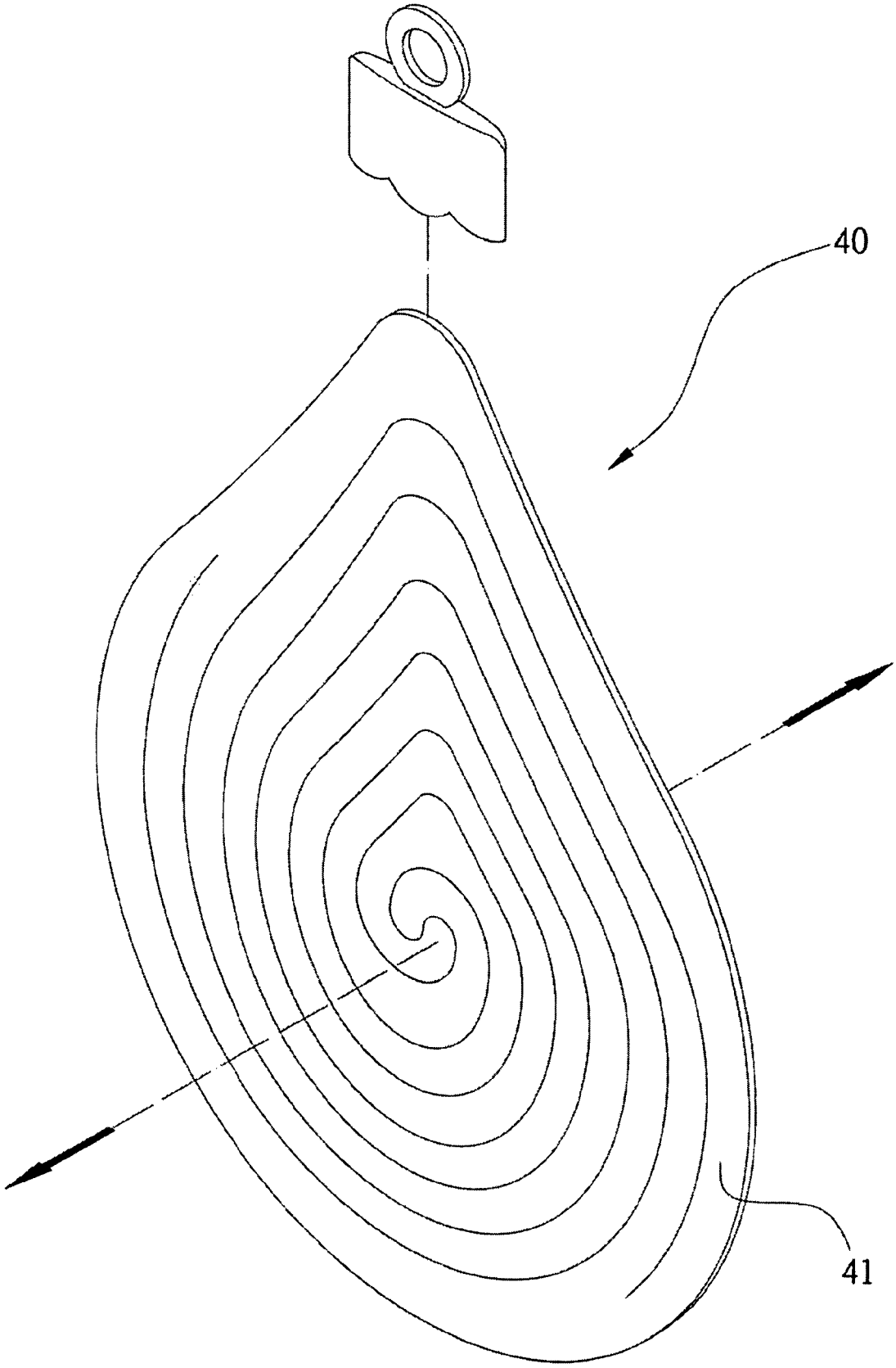
FIG. 6 is an exploded view of unexpanded state of an embodiment of the present invention.
Figure 7:
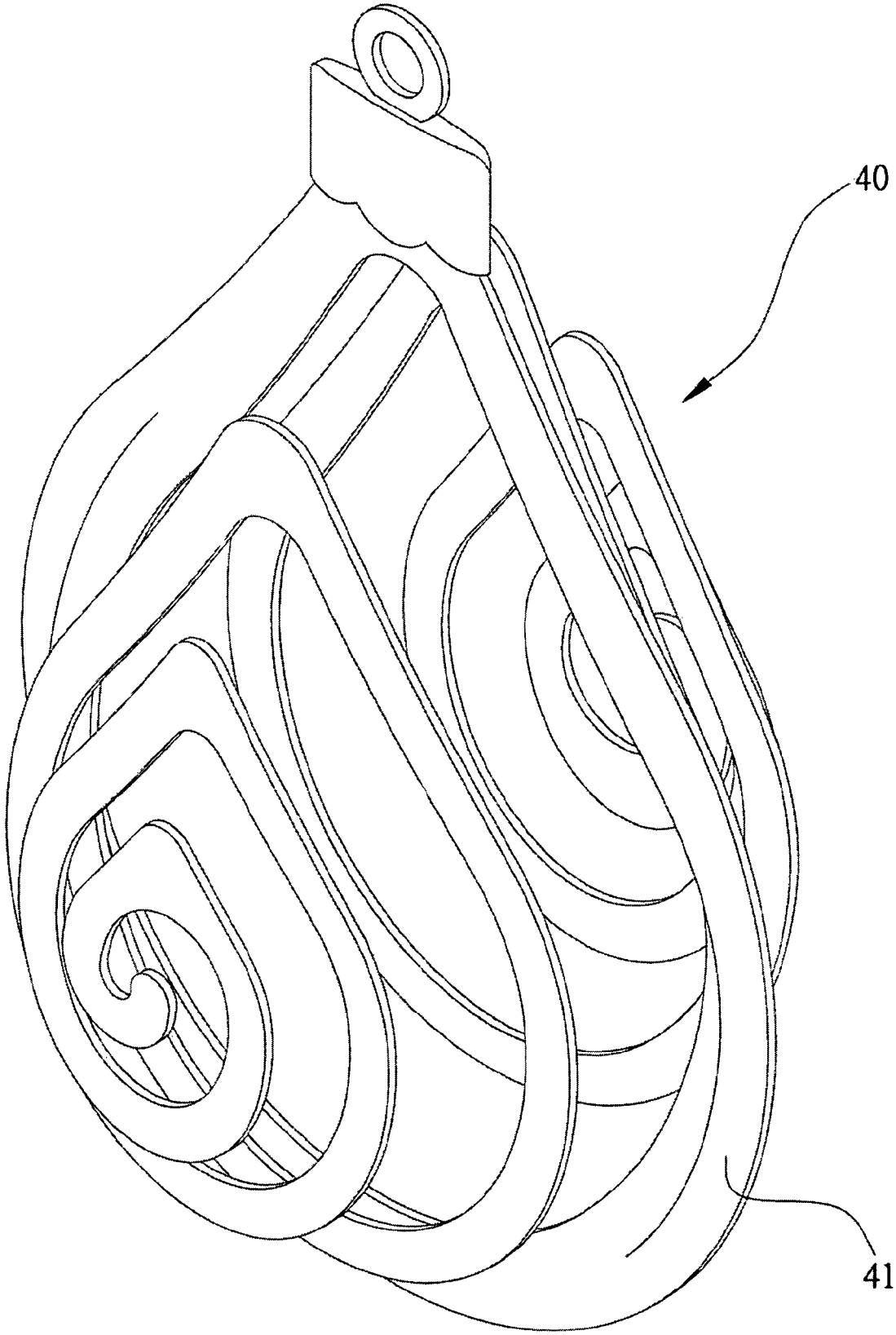
FIG. 7 is a tri-dimensional view of FIG. 6.

FIGS. 4 and 5 cooperatively show an embodiment of the present invention, wherein the outer edge portion 31 of the main body 30 can be disposed to the illustrated configuration, and the cutting lines 32, corresponding to the contour of the outer edge portion 31, form coiled phenix-eye shaped configuration. After the first convolution 33 and the second convolution 34 being pulled out along opposite directions and fixedly positioned, tri-dimensional change of special curve will generate. Moreover, referring to FIGS. 6 and 7, the configuration of the outer edge portion 41 of the main body 40 can be disposed to water-dropped configuration, and therefore, the decoration form tri-dimensional water-drop of hollowed-out.

Figure 8:
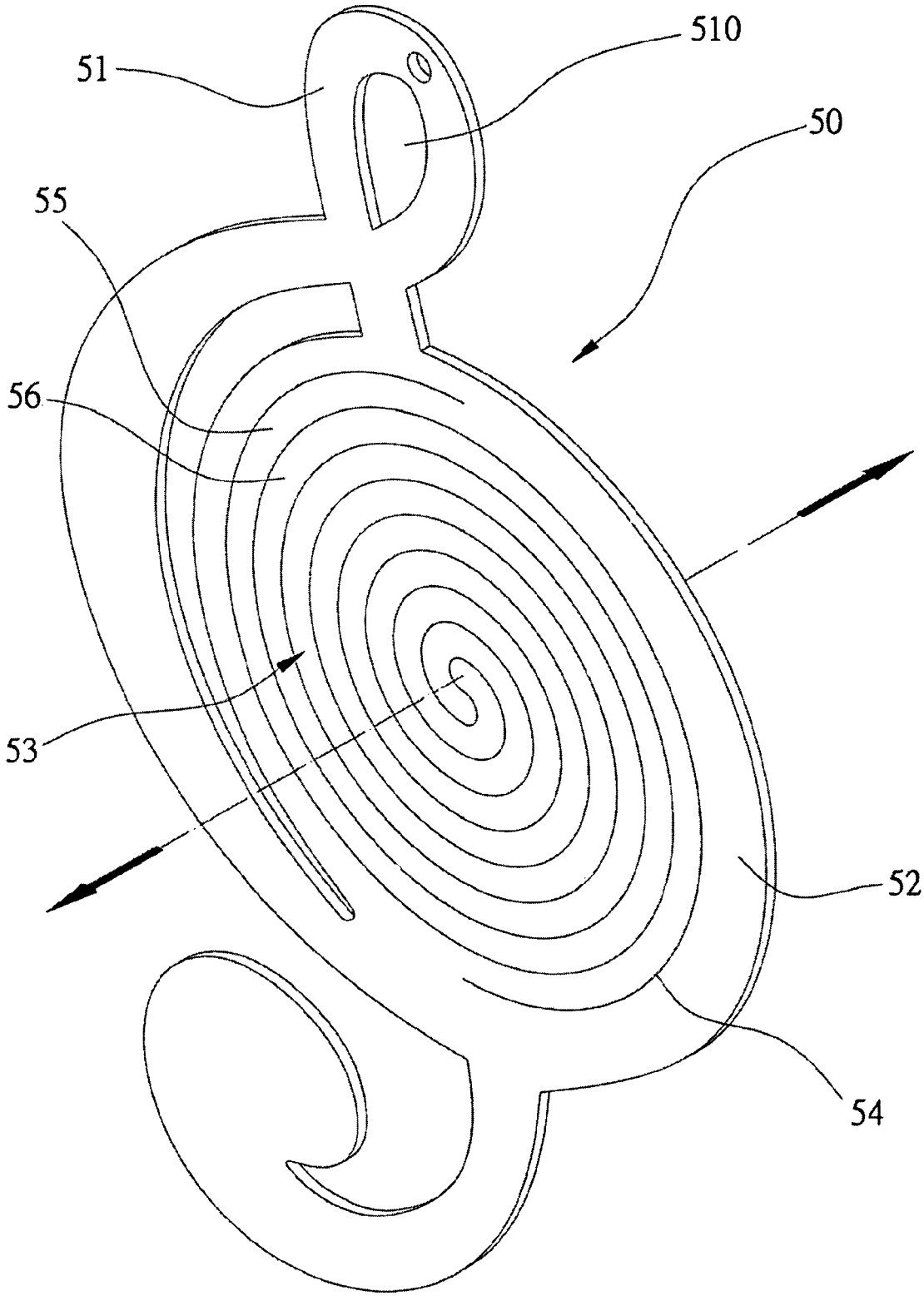
FIG. 8 is an exploded view of unexpanded state of an embodiment of the present invention.
Figure 9:
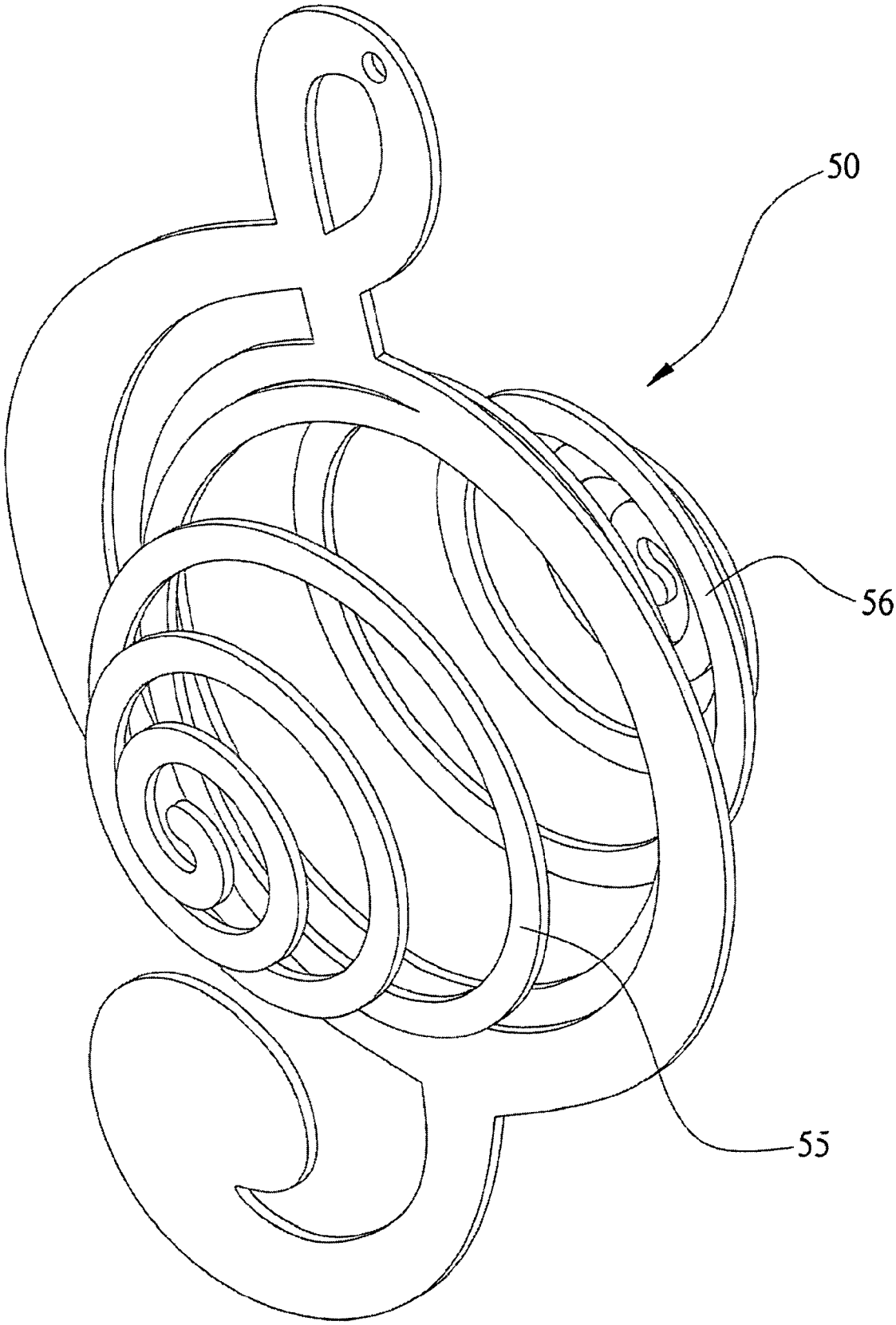
FIG. 9 is a tri-dimensional view of FIG. 8.

FIGS. 8 and 9 cooperatively show an embodiment of the present invention, wherein the combining element 51 is integrally formed with the main body 50 from a single piece, and the outer edge portion 52 is disposed to a musical noted configuration. The combining element 51 is formed at the top of the musical note, forming a perforation 510. The inner edge portion 53 has at least two disconnected coil cutting lines 54, for respectively forming the first convolution 55 and the second convolution 56, and cooperating with the pulling out of the first convolution 55 and the second convolution 56, forming tri-dimensional decoration.

Figure 10:
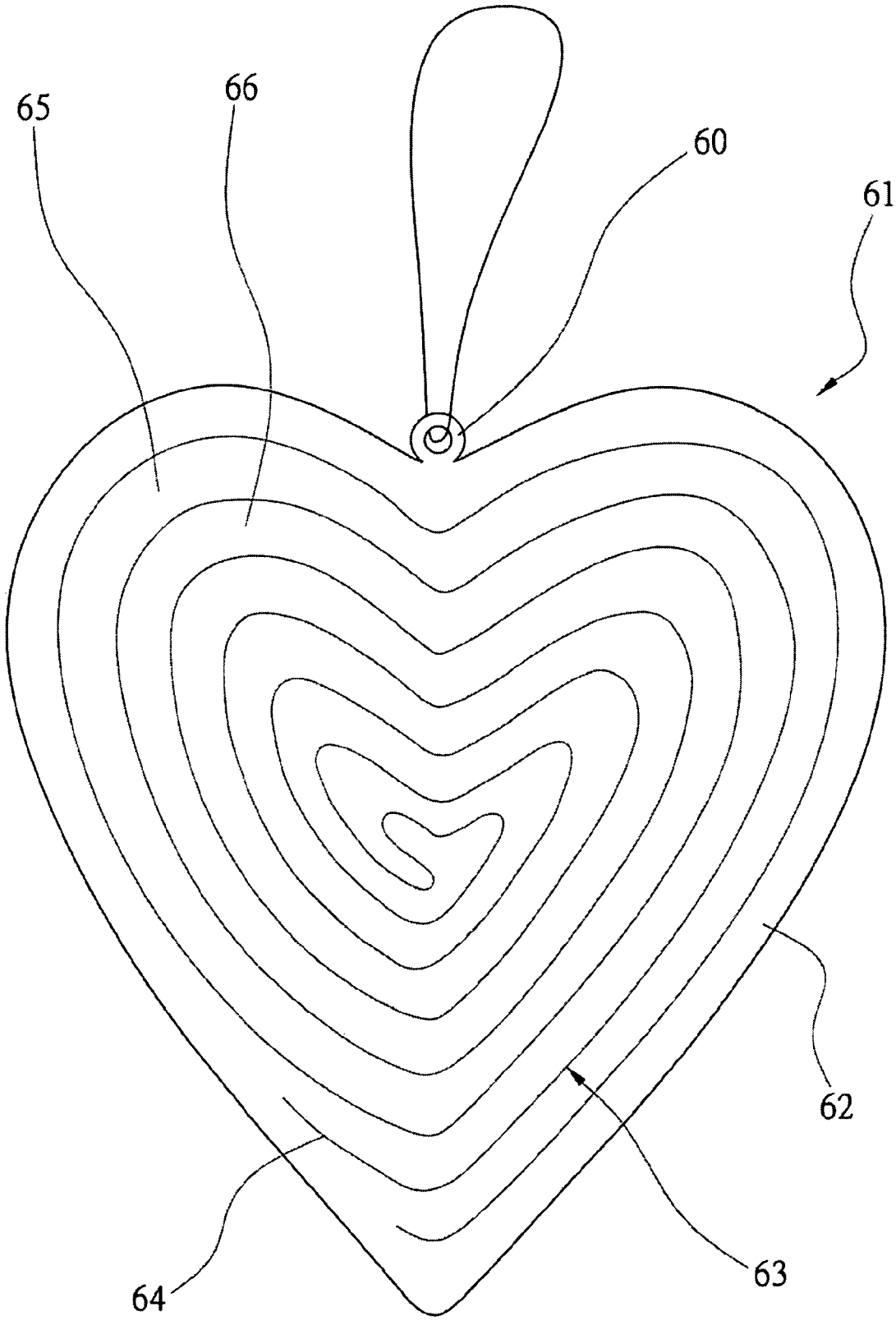
FIG. 10 is an exploded view of unexpanded state of an embodiment of the present invention.
Figure 11:
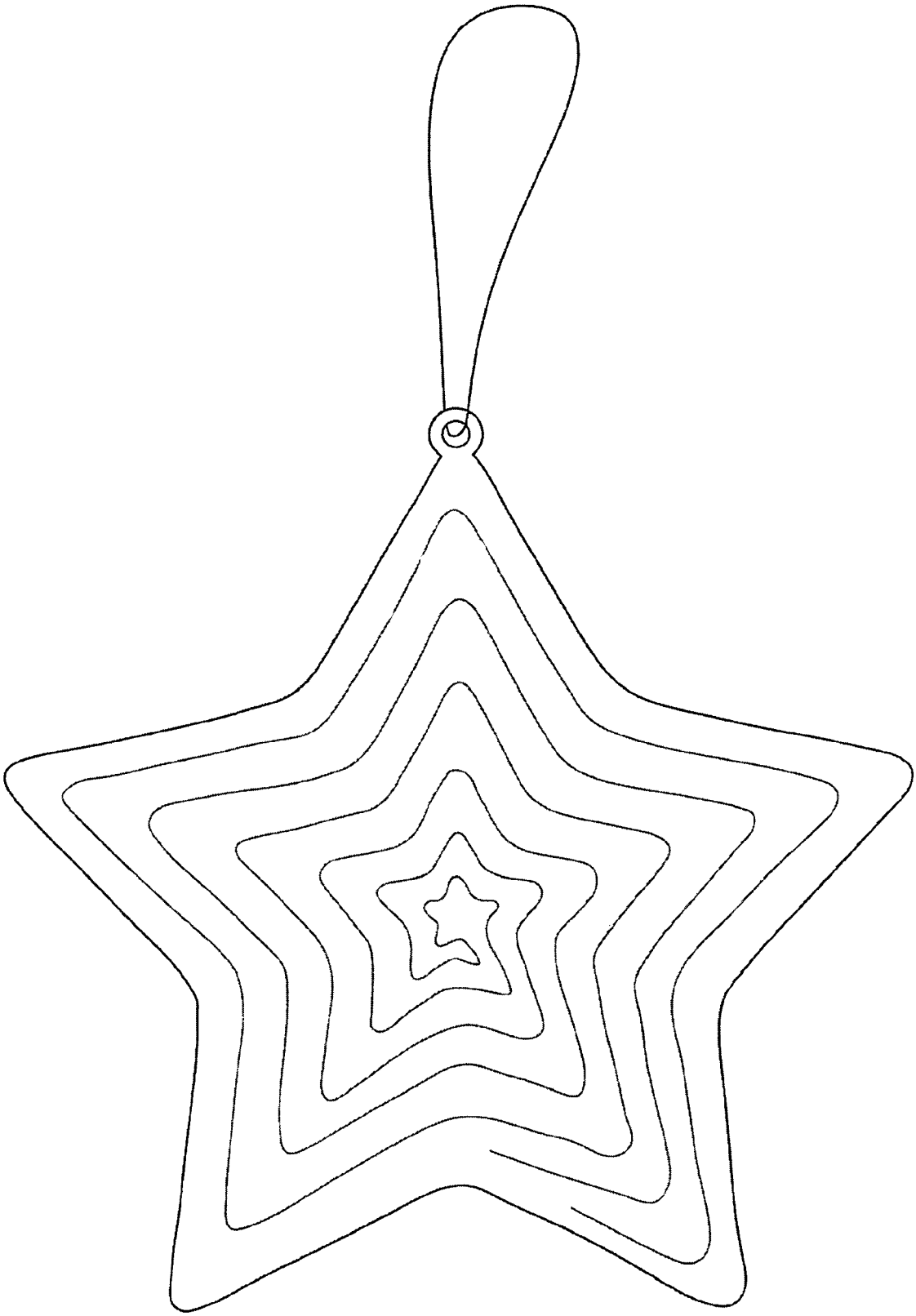
FIG. 11 is an exploded view of unexpanded state of an embodiment of the present invention.
Figure 12:
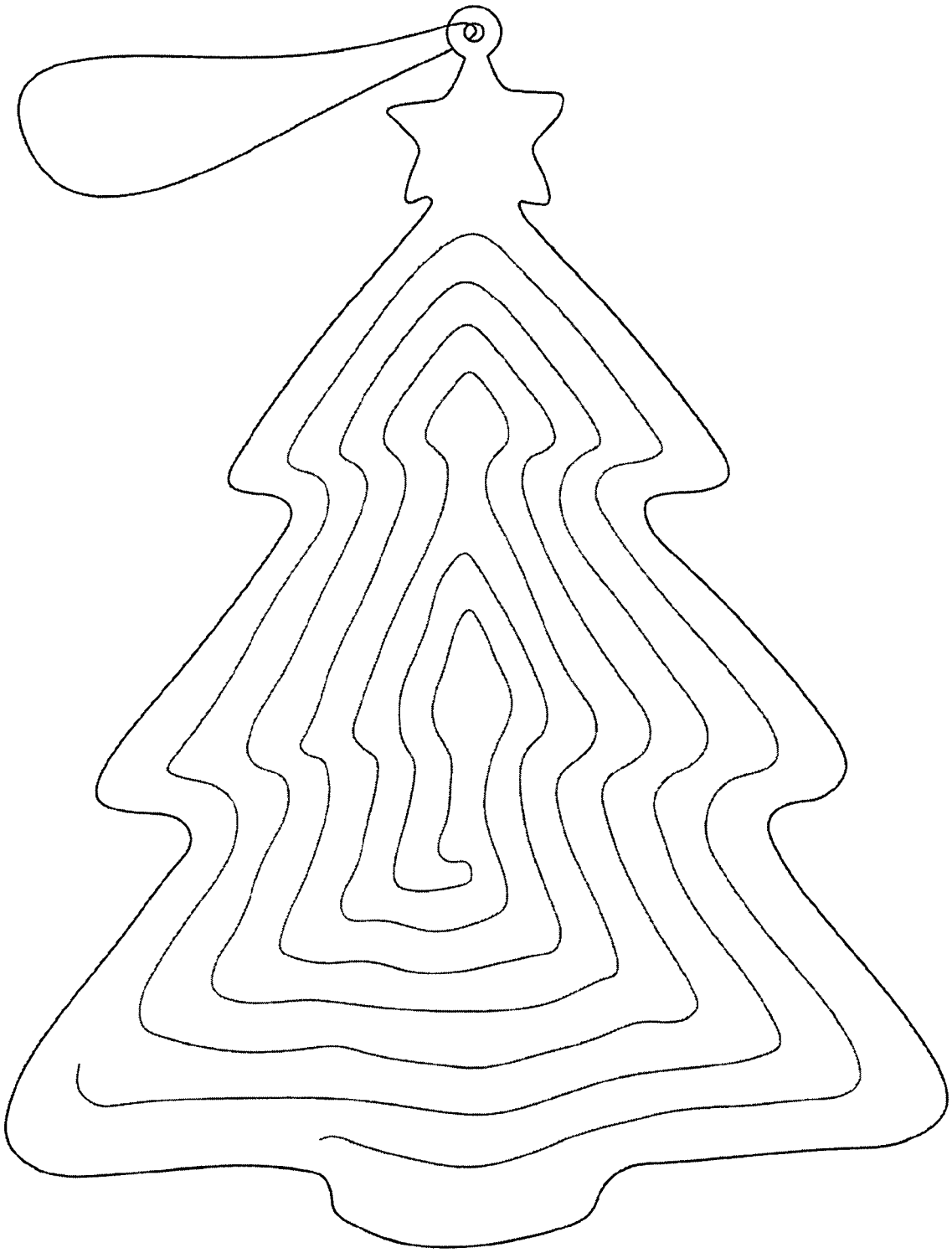
FIG. 12 is an exploded view of unexpanded state of an embodiment of the present invention.

FIGS. 10 through 12 respectively show an embodiment of the present invention, wherein the combining element 61 is integrally formed with the main body 60 from a single piece, and the outer edge portion 62 is disposed to heart-shaped configuration illustrated in FIG. 10, star-shaped configuration illustrated in FIG. 11, or Christmas tree shaped configuration illustrated in FIG. 12. The inner edge portion 63 has at least two disconnected coil cutting lines 64, and the initiating terminals of the cutting lines 64 can be disposed at a same side and adjacent to each other, to respectively form the first convolution 65 and the second convolution 66. By the same token, after pulling out the first convolution 65 and the second convolution 66, the main body can form the tri-dimensional decoration.

Figure 13:
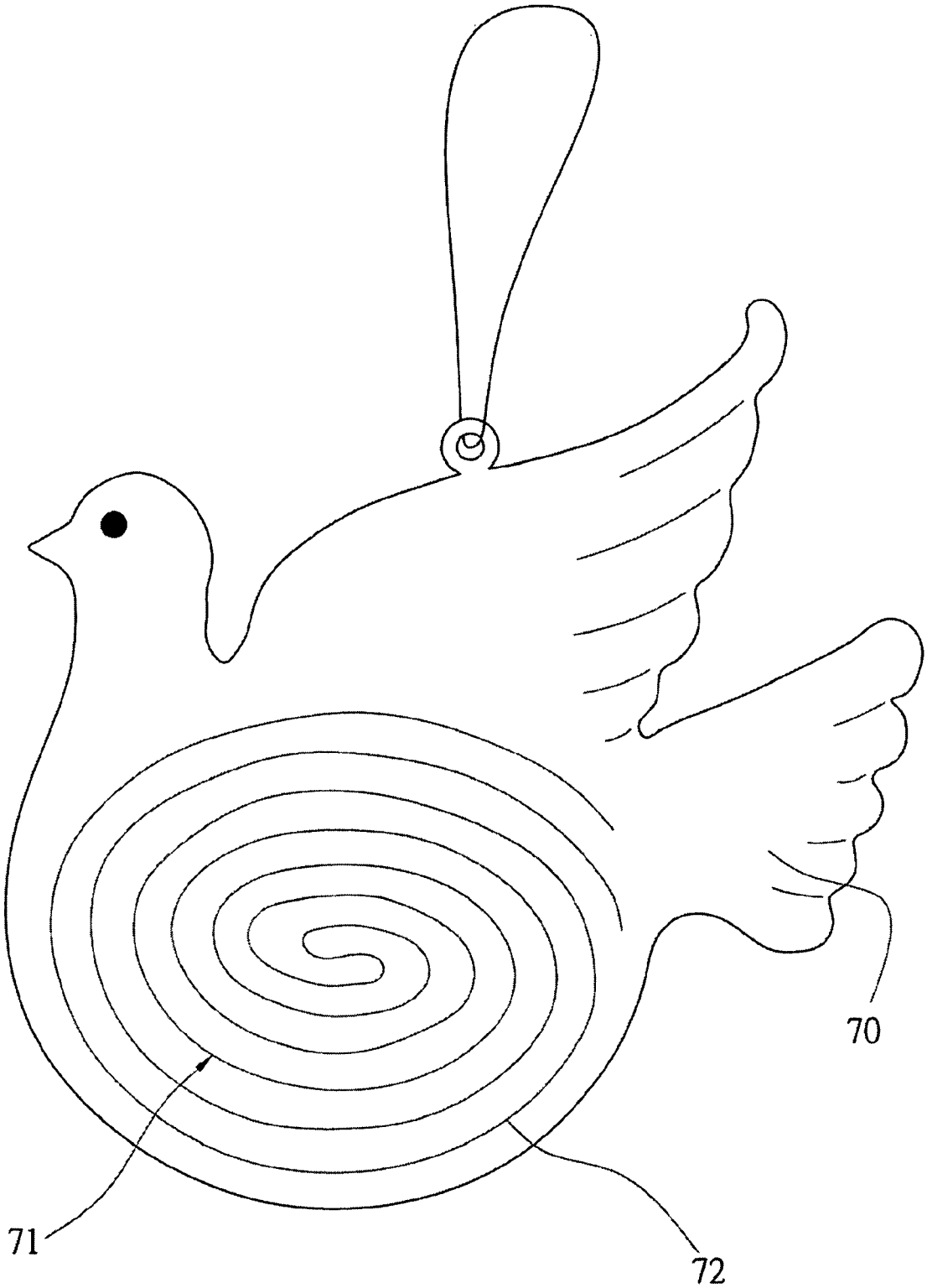
FIG. 13 is an exploded view of unexpanded state of an embodiment of the present invention.
Figure 14:
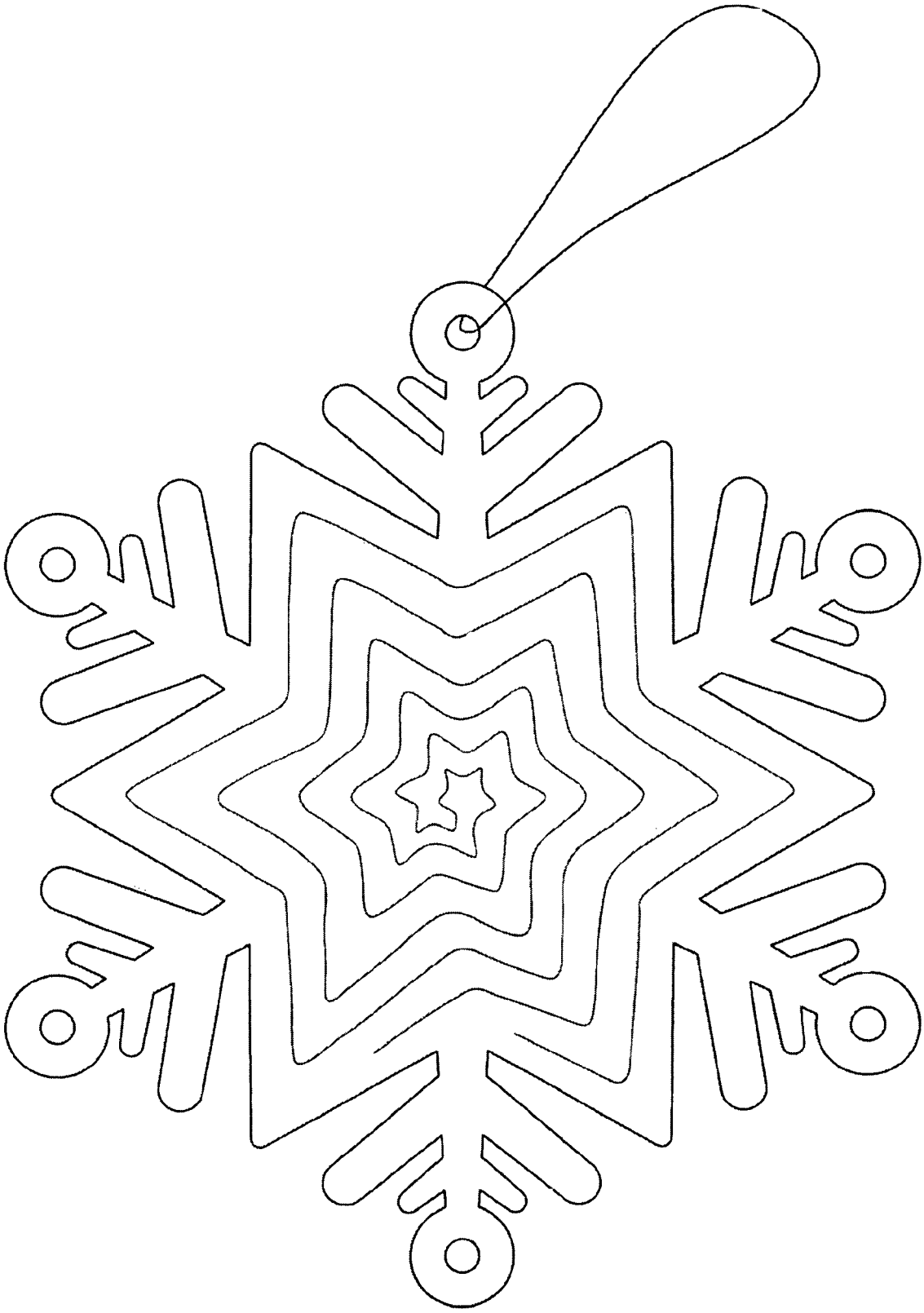
FIG. 14 is an exploded view of unexpanded state of an embodiment of the present invention.

FIGS. 13 and 14 respectively show an embodiment of the present invention, wherein the outer edge portion 70 can be designed, according to user's requirement, to desired outer configuration and shape, such as pigeon-like configuration in FIG. 13, or snowflake configuration in FIG. 14. Also, the inner edge portion 71 can also be designed, according to user's requirement, to have two different cutting lines 72 in different embodiments, such as ellipse cutting lines in FIG. 13, or hexagon cutting lines in FIG. 14.

Figure 15:
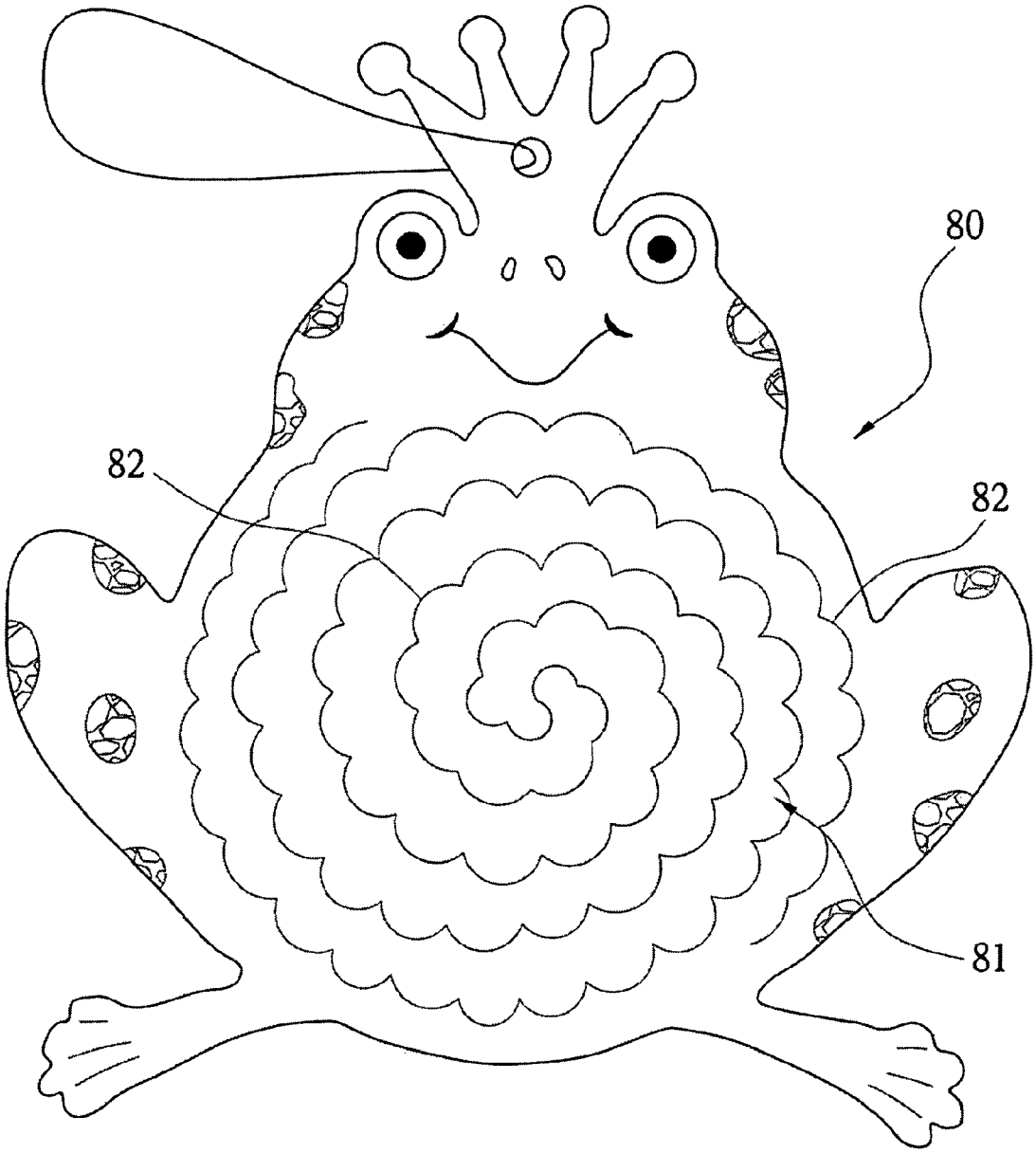
FIG. 15 is an exploded view of unexpanded state of an embodiment of the present invention.

FIG. 15 show an embodiment of the present invention, wherein the inner edge portion 81 of the main body 80 could have two cutting lines 82 of circular shape as a whole, the cutting lines 82 can be designed to be different curves or configurations according to user's requirement, such as wave shaped illustrated by FIG. 15, or triangular shaped, or continuous lines such as teeth shaped.

Moreover, at least an ornament element, such as, small bell, color balloon, or etc, could be disposed in the first convolution and the second convolution of the tri-dimensional decoration, for further increasing the variability of the present decoration.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A decoration comprising:

a shapable main body, the main body forming an outer edge portion and an inner edge portion, the outer edge portion being formed around a periphery of the inner edge portion, the inner edge portion having two disconnected coil cutting lines, the cutting lines respectively form an initiating terminal adjacent to the outer edge portion, and the cutting lines wrapping around along the main body, and the cutting lines equidistantly winding to a centre of the main body and connecting with each other, the inner edge portion separately forms mutually corresponded first convolution and second convolution by the cutting lines, initiating terminals of the first convolution and the second convolution respectively locating at adjacent sides of the cutting lines and respectively connecting to the outer edge portion.

2. The decoration as claimed in claim 1, wherein the initiating terminals of the cutting lines are disposed adjacent to opposite ends of the outer edge portion.

3. The decoration as claimed in claim 1, wherein the initiating terminals of the cutting lines are disposed to adjacent positions.

4. The decoration as claimed in claim 1, wherein the outer edge portion of the main body has a combining element.

5. The decoration as claimed in claim 4, wherein the combining element is a sheet body, and the combining element is fixed to the outer edge portion of the main body.

6. The decoration as claimed in claim 4, wherein the combining element is integrally formed with the outer edge portion from a single piece.

7. The decoration as claimed in claim 4, wherein the combining element has a perforation.

8. The decoration as claimed in claim 1, wherein the outer edge portion of the main body is disposed to a configuration of arbitrary shape.

9. The decoration as claimed in claim 1, wherein the cutting lines of the main body are actually mutual equidistant coil lines.

10. The decoration as claimed in claim 1, wherein the cutting lines of the main body are disposed to be different curves or configurations.

11. A decoration comprising:

a shapable main body, the main body forming an outer edge portion and an inner edge portion, the outer edge portion being formed around a periphery of the inner edge portion, the inner edge portion having two disconnected coil cutting lines, the cutting lines respectively form an initiating terminal adjacent to the outer edge portion, and the cutting lines wrapping around along the main body, and the cutting lines equidistantly winding to a centre of the main body and connecting with each other, the inner edge portion separately forms mutually corresponded first convolution and second convolution by the cutting lines, initiating terminals of the first convolution and the second convolution respectively locating at adjacent sides of the cutting lines and respectively connecting to the outer edge portion, the first convolution and the second convolution of the decoration being respectively pulled from the main body outwardly toward opposite sides of the main body for tensile position, making the first convolution and the second convolution respectively form tri-dimensional conical revolutions facing to different directions.

12. The decoration as claimed in claim 1, wherein the main body has at least an ornament element disposed in the first convolution and the second convolution of the tri-dimensional decoration.

* * * * *